US008888211B2

(12) United States Patent
Garvi et al.

(10) Patent No.: US 8,888,211 B2
(45) Date of Patent: Nov. 18, 2014

(54) PRINTING DEVICE

(75) Inventors: Joaquim Brugue Garvi, Barcelona (ES); Rafael Ulacia Portoles, Barcelona (ES); Eduardo Ruiz Martinez, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 120 days.

(21) Appl. No.: 13/553,594

(22) Filed: Jul. 19, 2012

(65) Prior Publication Data

US 2014/0022293 A1 Jan. 23, 2014

(51) Int. Cl.
*B41J 25/308* (2006.01)
*B41J 11/00* (2006.01)

(52) U.S. Cl.
CPC ..... *B41J 11/008* (2013.01)
USPC ..... 347/8

(58) Field of Classification Search
CPC .... B41J 25/308; B41J 25/304; B41J 25/3082; B41J 11/24
USPC ..... 347/8, 16, 37; 400/55, 56, 59
See application file for complete search history.

(56) References Cited

U.S. PATENT DOCUMENTS 6,874,956 B2 4/2005 Kelley et al.
7,434,901 B2 10/2008 Koh et al.
7,645,006 B2 * 1/2010 Schalk et al. ..... 347/8
2010/0328395 A1 12/2010 Chuang
2012/0133708 A1 5/2012 Miller et al.

FOREIGN PATENT DOCUMENTS

JP 2005081717 A 3/2005

OTHER PUBLICATIONS

Jaeger, C.W.; Color Solid Ink Printing; http://www.imaging.org/ist/resources/tutorials/solid_ink.cfm, 2009.

* cited by examiner

*Primary Examiner* — An Do

(57) ABSTRACT

A printing device comprises a medium handling section to handle a print medium; an image section to form an image on the print medium while the medium is handled by the medium handling section; a variable stop to support the medium handling section or the image section when the printing device is in a first configuration, the variable stop having at least two states, each state defining a respective separation between the medium handling section and the image section when in the first configuration, a movement section to cause relative movement between the medium handling section and the image section, the relative movement moving the printing device between the first configuration and a second configuration, where neither the medium handling section nor the image section is supported by the variable stop in the second configuration; the variable stop to change state when the printing device is in the second configuration.

20 Claims, 4 Drawing Sheets

PRINTING DEVICE

BACKGROUND

In printing devices, having a correct Printhead (or pen) to Paper Spacing (PPS) is important in obtaining good image quality. The thickness of print media may vary from type to type, leading to variation in the PPS between medium types. This can have a negative effect on image quality.

BRIEF DESCRIPTION OF THE DRAWINGS

Examples of the invention are further described hereinafter with reference to the accompanying drawings, in which.

DETAILED DESCRIPTION

Figure 1:
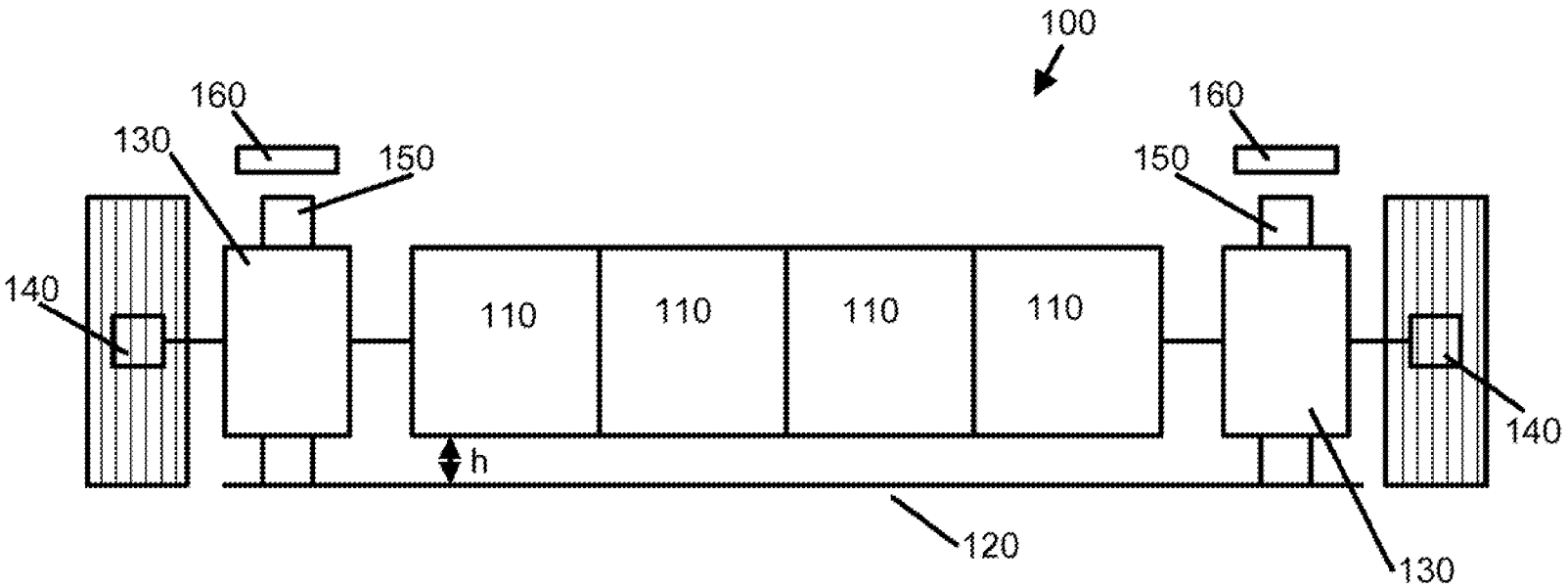
FIG. 1 shows a page wide array according to an example.

FIG. 1 shows an example of a Page Wide Array (PWA) printer 100. The PWA has an image forming section 110, such as an array of inkjet print heads, and a medium handling section 120, such as a platen. The medium is handled, guided, retained or supported by the medium handling section 120, and the image forming section 110 forms an image on the medium while it is handled by the medium handling section 120. The medium handling section 120 may transport the medium along a medium path (perpendicular to the plane of the page in FIG. 1) such that the medium passes under the image forming section 110, allowing an image to be formed over substantially the whole of the medium's upper surface.

The separation between the medium handling section 120 and the image forming section 110 is indicated by h. Typically, h should be uniform across the width of the medium to avoid artifacts in the image or variation in image quality across the width of the image. The PPS is defined by h and the thickness of the medium, t, such that PPS=h−t. Thus, for fixed h, variation in t leads to a variation in PPS.

The image forming section 110 is supported on stops 130, which are provided at respective ends of the image forming section, on respective sides of the medium path. The stops 130 are mechanical stops that rigidly hold the image forming section 110 relative to the medium handling section 120 in a position that keeps the height h of the image forming section 110 over the medium handling section 120 constant.

The image forming section 110 may be raised and lowered for maintenance and servicing by a movement section (e.g. lifting mechanism 140), such as a rack and pinion, or lead-screw arrangement. This facilitates operations such as capping, spitting, wiping and drop detection by providing access to the underside of the image forming section 110 and the top of the medium handling section 120. When the lifting mechanism has raised the image forming section 110, the image forming section is not supported by stops 130, and so is not rigidly supported. Accordingly, printing is not performed in this configuration, since the image forming section is not stably supported, and may be affected by vibrations that could lead to visible artifacts in the printed image.

Each stop 130 is variable and may be actuated, such that actuation of the stop 130 causes a change in the state of the stop 130, resulting in a change in the height at which the stop 130 supports the image forming section 110 over the medium handling section 120 (i.e. a change in h).

According to an example, the state of the stop 130 is changed while the stop is not supporting the image forming section 110. For example, the state of the stop 130 may be changed while the lifting mechanism 140 has raised, and is supporting, the image forming section 110. Accordingly, the mechanism for changing the state of the stop 130 is not required to raise and/or lower the image forming section 110. This permits simplification of the mechanism of the stop 130, and may make use of the existing lifting mechanism 140.

In some examples, stop 130 is moved by the lifting mechanism 140 with the image forming section 110, and is provided with a mechanical actuator 150 facing the direction of travel imparted by the lifting mechanism 140. This permits the stop 130 to be actuated by movement of the lifting mechanism causing the actuator 150 to engage with a detent 160, which may be stationary with respect to the medium handling section 120. This permits actuation of the stop 130 to be controlled by the lifting mechanism, and so does not require additional controls and actuators, thereby simplifying the mechanism of the stop 130.

Figure 2:
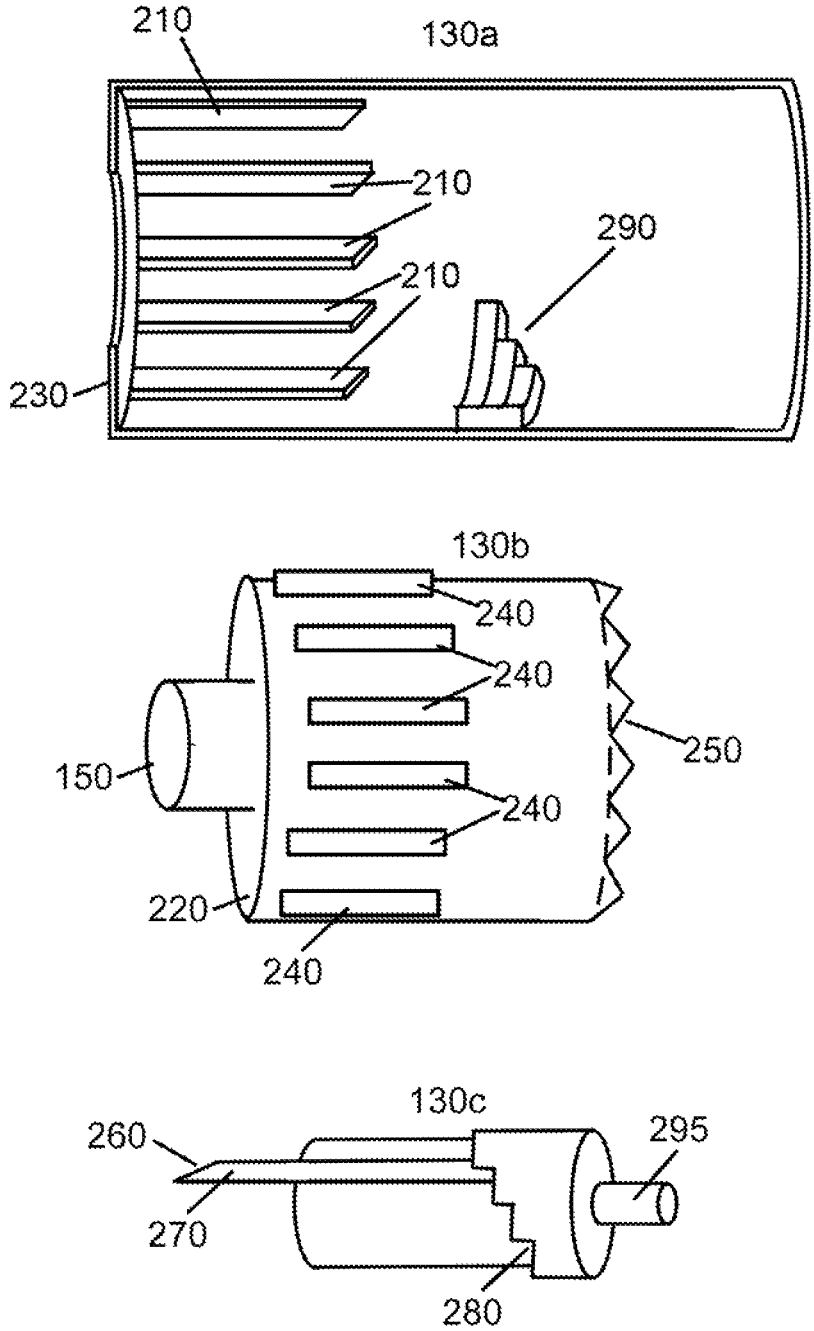
FIG. 2 shows an exploded view of a variable stop according to an example.
Figure 3:
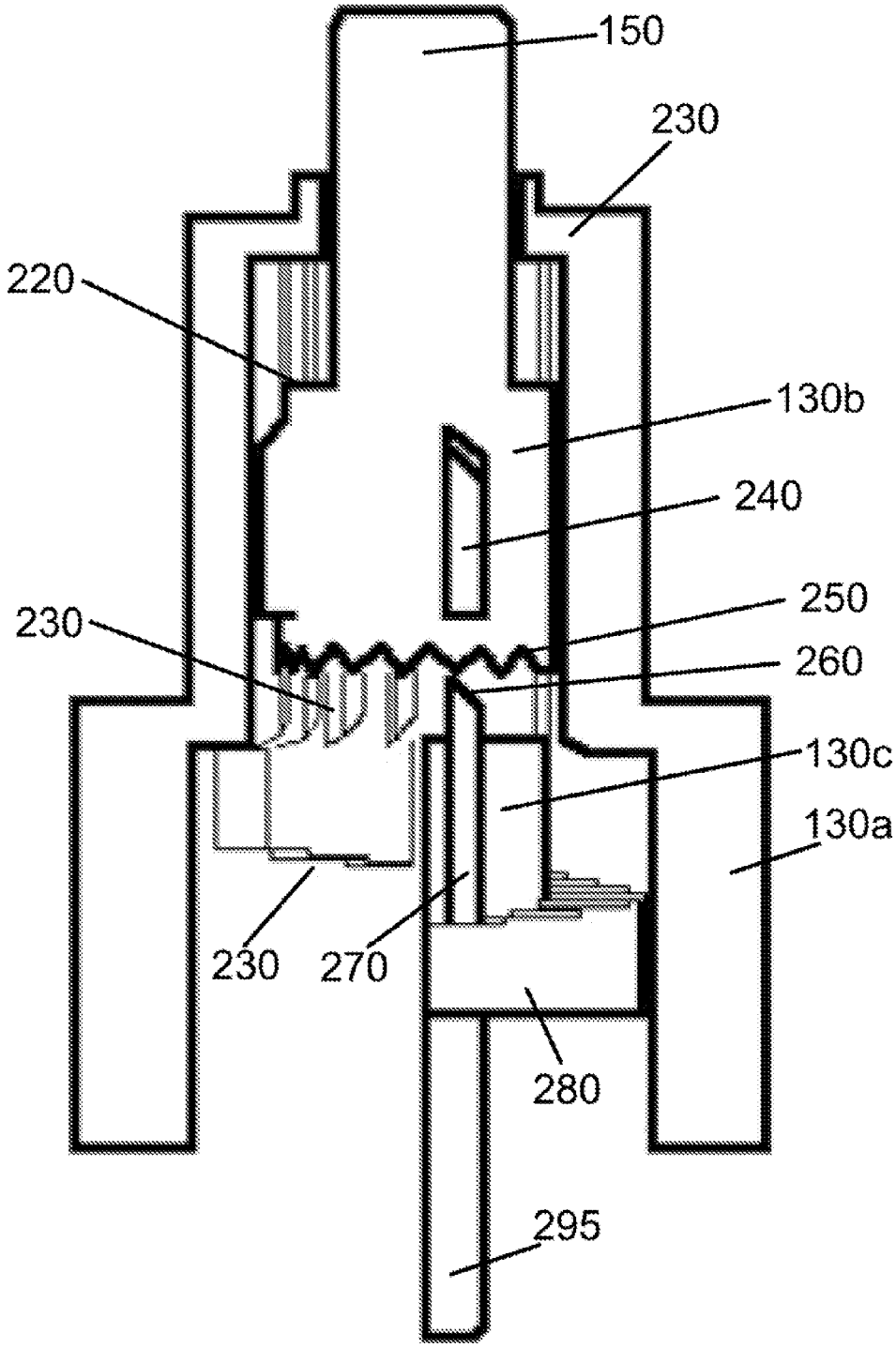
FIG. 3 shows a cutout of the stop of FIG. 2.

FIG. 2 shows an exploded view of a stop 130 according to an example. The stop 130 includes a body 130*a*, shown in section, a pusher crown 130*b*, and a sequencer 130*c*. The body 130*a* has a substantially cylindrical cavity, including a guide section 210. The guide section 210 is to guide the pusher crown 130*b* and sequencer 130*c*, and may include a rib or groove for engaging with respective portions of the pusher crown 130*b* and the sequencer 130*c*. Multiple ribs or groves may be provided, and result in the pusher crown 130*b* and sequencer 130*c* being more reliably guided. The guide section 210 may be formed on or in the substantially cylindrical inner surface of the cavity of the body 130*a*.

The pusher crown 130*b* may be substantially cylindrical and includes the actuator 150. In use, the pusher crown is placed within the cavity of the body 130*a*, such that the pusher crown 130*b* is retained in body 130*a* by shoulders 220 of the pusher crown 130*b* bearing against the lip 230 (or other retaining arrangement) of the body 130*a*. A spring, e.g. an axial spring, (not shown) may be provided to urge the pusher crown 130*b* (via the sequencer 130*c*) against the body 130*a* to maintain the contact between the shoulders 220 and the lip 230 while the stop 130 is not being actuated. The actuator 150 extends outside the body 130*a*, to enable the actuator 150 to contact detent 160. In an alternative arrangement the actuator 150 does not extend outside of the body 130*a*, and the detent 160 is configured to pass through a hole in the body 130*a* (e.g. the hole defined by lip 230) to contact the actuator 150.

Pusher crown 130*b* is provided with an engagement section 240 to engage with the guide section 210 of the body 130*a*. The engagement of the guide section 210 and the engagement section 240 prevents rotation of the pusher crown 130*b* relative to the body 130*a*, but permits movement of the pusher crown 130*b* relative to the body 130*a* along their mutual axis. The actuator 150 is such that actuation by the detent 160 causes the pusher crown 130*b* to move relative to the body 130*a* along the axis of the body 130*a*. The engagement section 240 may be provided on a substantially cylindrical outer surface of the pusher crown.

Pusher crown 130*b* is provided with a stepper surface 250 forming a slant plane, such that the stepper surface 250 and the actuator 150 are at opposite ends of the pusher crown 130*b* along the axial direction.

In use, the sequencer 130*c* is positioned inside the body 130*a*, such that a bearing face 260 of the sequencer 130*c* slideably bears or mates against the stepper surface 250 of the pusher crown 130*b*. The sequencer is biased, e.g. by a spring (not shown) towards the pusher crown 130*b*, the biasing being in an opposite direction to the direction of movement of the pusher crown 130*b* when the actuator 150 is pushed by the detent 160. For example, a spring may be provided between the sequencer 130*c* and a base (not shown) of the body 130*a*, the base being located at the an of the body 130*a* opposite the lip 230.

The sequencer 130*c* includes an engagement section 270 for engaging with the guide section 210 of the body 130*a*. As with the engagement section 240 pusher crown 130*b*, engagement of the engagement section 270 of the sequencer 130*c* with the guide section 210 prevents rotation of the sequencer 130*c* relative to the body 130*a*, but permits relative axial movement. The engagement section 270 may be formed on a substantially cylindrical outer surface of the sequencer 130*c*.

The sequencer 130*c* includes a base 295. The base 295 is arranged to contact a support surface when the printer is in a printing configuration, such that the weight of the image forming section 110 is supported via the base 295.

The sequencer 130*c* includes a stepped spacer 280 having a plurality of steps, the steps arranged to contact and bear against a limiter 290 of the body 130*a*. The limiter 290 may be formed on the substantially cylindrical internal surface of the body 130*a*. The contact between the stepped spacer 280 and the limiter 290 defines a distance between the base 295 and a portion of the body 130*a* anchored relative to the image forming section 110. Accordingly, the contact between the stepped spacer 280 and the limiter 290 defines the distance h between the image forming section 110 and the medium support section 120, thus also defining the PPS.

With the above arrangement, in a printing configuration the image forming section 110 is supported on the support surface via the base 295, spacer 280, limiter 290, and a connection or contact (either direct or indirect) between the body 130*a* and the image forming section 110.

The limiter 290 may be arranged to contact more than one step of the stepped spacer 280. In the example of FIG. 2 the limiter 290 is to contact three steps of the stepped spacer 280. This arrangement reduces the pressure on the spacer 280 and limiter 290 without decreasing the number of steps of the spacer 280. If the spacer 280 has n steps of equal size around the circumference, and the limiter contacts m steps, the number of different states (values of h) provided by the spacer is n−(m−1).

In some examples, the spacer 280 may alternatively be arranged to contact m steps of the limiter 290 in n−(m−1) states and fewer than m steps in up to m−1 states. For example, where the limiter 290 has three steps and the spacer 280 has 16 steps, there may be 14 states in which all three steps of the limiter 290 contact the spacer 280, one state in which two steps of the limiter 290 contact the spacer 280, and one state in which one step of the limiter 290 contacts the spacer 280. This results in n (i.e. 16) states, but in two of these states the support is provided by fewer steps of the limiter 290. In some examples not all of the possible m−1 states are used, for example in the case above, the state in which one step of the limiter 290 contacts the spacer 280 might not be used, resulting in 15 states.

Figure 4:
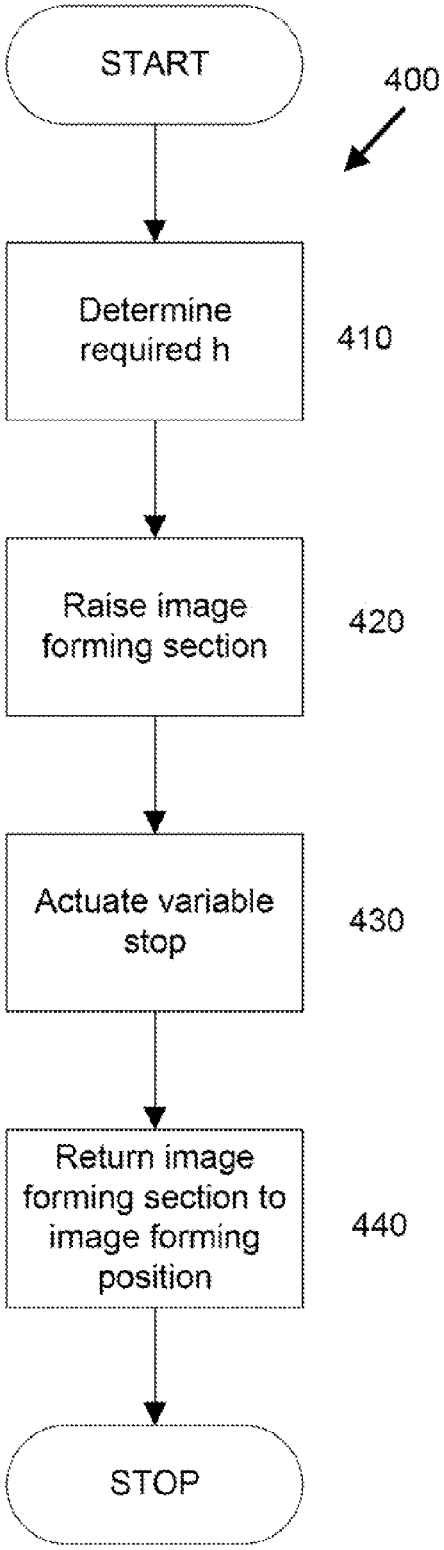
FIG. 4 illustrates a method according to an example.

In order to change the state of the stop 130, that is change the step(s) of the spacer 280 in contact with limiter 290, the method 400 illustrated in FIG. 4 may be used. The required value of h is determined 410, either based on manual input (e.g. by a user entering a value of h, entering a medium thickness, or directly entering a value of h). The image forming section 110 is raised 420 by the raising mechanism 140. The actuator is actuated 430. In some examples, the actuation is the result of the actuator 150 being pushed by detent 160. The actuator 150 is pushed, causing the pusher crown 130*b* to move axially along a first axial direction relative to the body 130*b*, under the guidance of the guide section 210. The stepper surface 250 pushes the bearing face 260, causing axial movement of the sequencer 130*c* relative to the body 130*a*. The axial movement of the sequencer 130*c* is initially under the influence of the guide section 210, but the axial movement is such that engagement section 270 of the sequencer 130*c* passes out of the influence of the guide section 210. For example, a rib of the sequencer 130*c* may pass beyond an axial extent of a guide grove of the body 130*a*. The sequencer 130*c* may then rotate relative to the body 130*a*. Stepper surface 250 of the pusher crown 130*b* and bearing face 260 of the sequencer 230*c* are arranged to cause the sequencer to rotate a fixed amount in a first circumferential direction around its axis, relative to the body 130*a* (and relative to the pusher crown 130*b*). In the example of FIG. 2 this is achieved by the stepper surface 250 being angled such that as the sequencer 130*c* is biased towards the pusher crown 130*b*, the bearing face 260 slides across the stepper surface 250 in the first circumferential direction, resulting in relative rotation about the axis. The angle of the stepper surface 250 changes after a predetermined distance (or angle about the axis) to limit the relative movement of the bearing face 260 and so limit the relative rotation of the sequencer 130*c*.

The actuator 150 is then released (possibly due to the operation of the lifting mechanism 140 to lower the image forming section 110), and the biasing of the sequencer 130*c* against the pusher crown 130*b* causes the sequencer 130*c* and pusher crown 130*b* to return along a second axial direction (opposite the first axial direction). The engagement section 270 of the sequencer 130*c* re-engages with the guide section 120 of the body 130*a*. However, the re-engagement is such that the sequencer turns a further fixed amount in the first circumferential direction relative to the body during the re-engagement. In the example of FIG. 2, the engagement section 270 includes a rib, and the guide section 120 is formed by a plurality of ribs defining channels therebetween. The channels run axially along the inner surface of the body 130*a*, and the rib of the engagement section 270 is arranged to engage with one of the channels and move axially therein. In the example of FIG. 2, the bearing face 260 is provided on the rib of the engagement section 270. As the sequencer moves axially toward re-engagement with the guide section 210, the bearing face 260 bears against the rib of the guide section 210. One or both of the bearing fade 260 and the rib of the guide section 120 are angled to cause the further relative rotation of the sequencer. The rib of the engagement section 270 is then guided to a channel of the guide section 210.

The axial movement of the sequencer 130*a*, caused by the bias (in the second axial direction) toward the push crown 130*b*, is limited by the spacer 280 contacting the limiter 290.

The lifting mechanism 140 returns the image forming section 110 to the image forming configuration 440, with the image forming section 110 resting on the variable stop 130, such that h is defined by the variable stop.

The spacer 280 may be provided with n steps of equal surface area and angular extent. The total rotation of the sequencer relative to the body in a single actuation is 1/n rotation (i.e. 360/n degrees or $2\pi/2$ radians). In some examples the rotation caused by the stepping surface 250, and the rotation caused by the re-engagement of the engagement section 270 is substantially equal, that is each is ½ n of a rotation.

According to a specific example, the spacer 280 has 16 steps, and the limiter 290 is arranged to contact three of the steps of the spacer 280 simultaneously. Accordingly, the spacer 280 provides 14 axial displacements (14 different values of h). Each actuation of the stop 130 causes the sequencer to rotate by 1/16 of a rotation, and the axial displacement to increase by one step, until at the maximum value of h. Then, three actuations (the number of steps contacted by the limiter 290) of the stop 130 are required to return the stop to the lowest value of h. For examples in which the number of steps of the limiter 290 in contact with the spacer 280 may be fewer than the number of steps of the limiter 290, the number of additional actuations to return the stop to the lowest value of h may be varied accordingly. For example where the spacer 280 has n steps and the stop 130 has n states, a single actuation moves the stop between the highest state (with one step of the limiter 290 in contact with the spacer 280) and the lowest state (with all steps of the limiter 290 in contact with steps of the spacer 280).

According to some examples, the steps may all be of an equal height, resulting in regular intervals in the attainable values of h. This is advantageous when the limiter 290 contacts more than one step, as it simplifies the arrangement of the limiter 290 and spacer 280. In some examples, each step may have a height of 0.5 mm.

Where two stops 130 are provided, they may be actuated in unison by bringing the actuators 150 of both stops 130 into contact with respective detents 160. This can be achieved by the lifting mechanism 140 moving both stops 130 to simultaneously contact the detents.

In some examples with more than one stop 130, a sensor may be provided to detect differing levels in the stops 130. Such differing levels may result if only one stop 130 is actuated. In response to such a detection, a user may be alerted and/or the stops 130 may be individually actuated to bring them to the same level, for example, by raising one side of the image forming section 110 by the lifting mechanism 140 to bring the actuator 150 of only one of the stops 130 into contact with the respective detent 160.

In some examples a medium thickness may be automatically detected, and the stop(s) 130 adjusted automatically to result in a suitable PPS.

In the example successive actuations of the stop 130 caused the PPS to increase in steps, until the maximum PPS was reached and the stop 130 is returned to the state of minimum PPS. However, in an alternative arrangement, successive actuations of the stop 130 may cause the PPS to decrease in steps, until a minimum PPS is reached, and subsequent actuation(s) will return the stop to the maximum PPS. By providing steps that increase and decrease in height around the circumference the PPS need not change monotonically during a complete rotation from a maximum (minimum) value.

Accordingly, a variable stop 130 may be provided that permits a variation in h. This, in turn, may enable printing on media of various thicknesses without loss of image quality.

The stop 130 of FIG. 2 has a simple arrangement that does not require additional actuators, reducing cost and failure rates. The example of FIG. 2 does not require manual operation. Further, the stop of FIG. 2 may be compact and lightweight, which is beneficial in a crowded printing system. These properties also permit fast actuation and reduce susceptibility to vibrations.

The examples of FIGS. 1 and 2 provide a hard stop that is rigid and stiff. This avoids loss of image quality due to vibrations. Moreover, a hard stop can be precisely machined, and so provides accuracy in the PPS (i.e. the PPS and/or the separation between the medium handling section and the image section can be accurately defined).

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers or characteristics described in conjunction with a particular aspect or example of the invention are to be understood to be applicable to any other aspect or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing examples.

The invention claimed is:

1. A printing device with variable stop to define a PPS comprising:

a medium handling section to handle a print medium;

an image section to form an image on the print medium while the print medium is handled by the medium handling section;

a variable stop to support the medium handling section or the image section when the printing device is in a first configuration, the variable stop actuated by a lifting mechanism, the variable stop having at least two states, each state defining a respective separation between the medium handling section and the image section when in the first configuration, a movement section to cause relative movement between the medium handling section and the image section, the relative movement moving the pruning device between the first configuration and a second configuration, where neither the medium handling section nor the image section is supported by the variable stop in the second configuration; wherein the variable stop is to change state when the printing device is in the second configuration.

2. A printing device according to claim 1, wherein the printing device is a page wide array printer.

3. A printing device according to claim 2, further comprising a further variable stop, each variable stop having a same configuration, the variable stop and further variable stop being provided either side of a medium path defined by the medium handling section.

4. A printing device according to claim 1, wherein the movement section includes a lifting mechanism to lift the image section for servicing operations.

5. A printing device according to claim 1, wherein the movement section is to move the variable stop such that in the second configuration an actuator of the variable stop is actuated by contact with a detent, and the variable stop changes state in response to the actuation.

6. A priming device according to claim , wherein actuation of the variable stop causes relative rotation between a stepped spacer and a limiter, wherein contact between the stepped spacer and the limiter defines the state of the variable stop.

7. A printing device according, to claim 1, wherein the first configuration is a printing configuration, and the image section is to form an image on the medium only in the first configuration.

8. A printing device according to claim 1, wherein the variable stop includes a pusher crown, and a sequencer, and wherein the body of the variable stop has a substantially cylindrical cavity including a guide section, the guide section to guide the pusher crown and the sequencer.

9. A printing device according to claim 8, wherein the pusher crown is retained in the body of the variable stop by shoulders of the pusher crown bearing against a retaining arrangement of the body of the variable stop, and an axial spring is provided to urge the pusher crown via the sequencer against the body of the variable stop to maintain contact between the shoulders and the lip while the variable stop is not being actuated.

10. A printing device according to claim 8, Wherein the pusher crown is provided with a stepper surface forming a slant plane, such that the stepper surface and the actuator are at opposite ends of the pusher crown along an axial direction.

11. A variable stop to define a PPS, the variable stop comprising:

a limiter, a stepped spacer to contact the limiter, the PPS being defined by a step of the stepped spacer in contact with the limiter, and a lifting mechanism, wherein actuation of the variable stop by the lifting mechanism causes relative rotation between the stepped spacer and the limiter while the variable stop and limiter are not in contact, the relative rotation controlling a step of the stepped spacer to contact with the limiter.

12. A variable stop according to claim 11, wherein the limiter is fixed relative to a body, the body includes a guide section to prevent relative rotation of the stepped spacer and the body, actuation of the variable stop causes axial movement of the stepped spacer relative to the body along a direction parallel to the axis of the relative rotation, the axial movement removes the stepped spacer from the influence of the guide section, permitting rotation of the stepped spacer relative to the body, whereby the step to contact the limiter is changed.

13. A variable stop according to claim 12, further comprising a cylindrical pusher crown rotationally fixed relative to the body, wherein actuation of the pusher crown causes the axial movement, of the stepped spacer, the stepped spacer is biased against the pusher crown and the contact therebetween is such that the stepped spacer is rotated a first amount when removed from the influence of the guide section.

14. A variable stop according to claim 13, wherein when the stepped spacer returns to the influence of the guide section the stepped spacer is rotated a second amount.

15. A variable stop according to claim 14, wherein the sum of the first and second amount corresponds to a size of the step.

16. A variable stop according, to claim 14, wherein the stepped spacer has n steps, and the sum of the first and second amount is 1/n of a complete rotation.

17. A variable stop according to claim 11, wherein a number of different PPSs defined by the variable stop is fewer than the number of steps of the stepped spacer.

18. A variable stop according to claim 11, wherein the limiter is to contact a plurality of the steps of the stepped spacer.

19. A method of adjusting a PPS, the method comprising:

raising an image forming, section of a printing device by a lifting mechanism;

actuating a variable stop by the lifting mechanism while the image forming section is raised to change a state of the variable stop;

lowering the image forming, section to an image forming position, in which the variable stop supports the image forming section, and the height of the image forming section is determined by the state of the variable stop.

20. A method according to claim 19, further comprising:

during the raising, bringing an actuator of the variable stop into contact with a detent to actuate the variable stop.

* * * * *